US006287212B1

(12) United States Patent
Wetherell et al.

(10) Patent No.: US 6,287,212 B1
(45) Date of Patent: Sep. 11, 2001

(54) GOLF BALL DELIVERY SYSTEM

(76) Inventors: Bruce B. Wetherell, 1360 Highland Dr., Clearwater, FL (US) 33764; Ken Ko, 2956 Saber Dr., Clearwater, FL (US) 33759; William Betts, 2016 Montana Ave., NE, St. Petersburg, FL (US) 33703

( * ) Notice: Subject to any disclaimer, the term of this patent is extended or adjusted under 35 U.S.C. 154(b) by 0 days.

(21) Appl. No.: 09/557,706

(22) Filed: Apr. 25, 2000

(51) Int. Cl.[7] ..... A63B 69/36

(52) U.S. Cl. ..... 473/163; 473/182; 473/194; 198/358

(58) Field of Search ..... 473/168, 163, 473/182, 183, 184, 194; 198/442, 367, 360, 722, 358, 437

(56) References Cited

U.S. PATENT DOCUMENTS

| | | | | |
|---|---|---|---|---|
| 1,229,979 | * | 6/1917 | Kyle | 209/121 |
| 2,670,835 | * | 3/1954 | Huttman | 198/31 |
| 3,407,932 | * | 10/1968 | Northoff | 209/121 |
| 3,599,980 | * | 8/1971 | Harmond | 473/163 |
| 5,738,593 | * | 4/1998 | Coury | 473/135 |
| 5,766,085 | * | 6/1998 | Knez | 473/132 |

* cited by examiner

*Primary Examiner*—Stephen F. Gerrity
*Assistant Examiner*—Gary B. Solomon
(74) *Attorney, Agent, or Firm*—Larson & Larson, P.A.; James E. Larson

(57) ABSTRACT

Lifting golf balls in a vertical tube from a lifting station using spaced apart motorized wheels with finger projections for projecting into side openings in the vertical tube. The golf balls are allowed to fall by gravity from an apex of the vertical tube to a diverter for directing the golf balls to a particular dispenser apparatus.

12 Claims, 12 Drawing Sheets

GOLF BALL DELIVERY SYSTEM

FIELD OF THE INVENTION

This invention relates to a system for dispensing golf balls. More particularly, it refers to a system for cleaning, automatically transporting and dispensing golf balls to a golfer in a practice mode.

BACKGROUND OF THE INVENTION

Practice golf ranges have proliferated during the past fifteen years because of the increased popularity of golf. The typical practice range uses a pick-up vehicle to retrieve practice balls. In most cases, the retrieved balls are washed and then either hand packed into wire baskets or fed by hand into a dispenser that dispenses a set number of balls in response to coins deposited into slots on the dispenser. This system is time consuming and service staff intensive.

A system is needed which will accelerate the delivery of golf balls from the pick-up vehicle to the dispenser without the need for intervention by several staff personnel.

SUMMARY OF THE INVENTION

I have invented a system for automatic direct delivery of retrieved golf balls from a cleaning station to multiple golf ball dispensers located at a practice range. My system commences at a cleaning station where golf balls have been deposited by the golf ball retriever or pick-up vehicle. After washing, the golf balls are rotated on a tray from which they fall into a channel where they are picked up by a flange projection on the outer circumference of continuously operated rollers and lifted in a tube to a height of about thirty feet, after which they fall by gravity at about 4 inches every ten feet to a diverter electromagnetically operated to direct the balls to two or more golf ball dispensers from which a player can obtain a basket of golf balls by depositing a coin into the dispensers.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
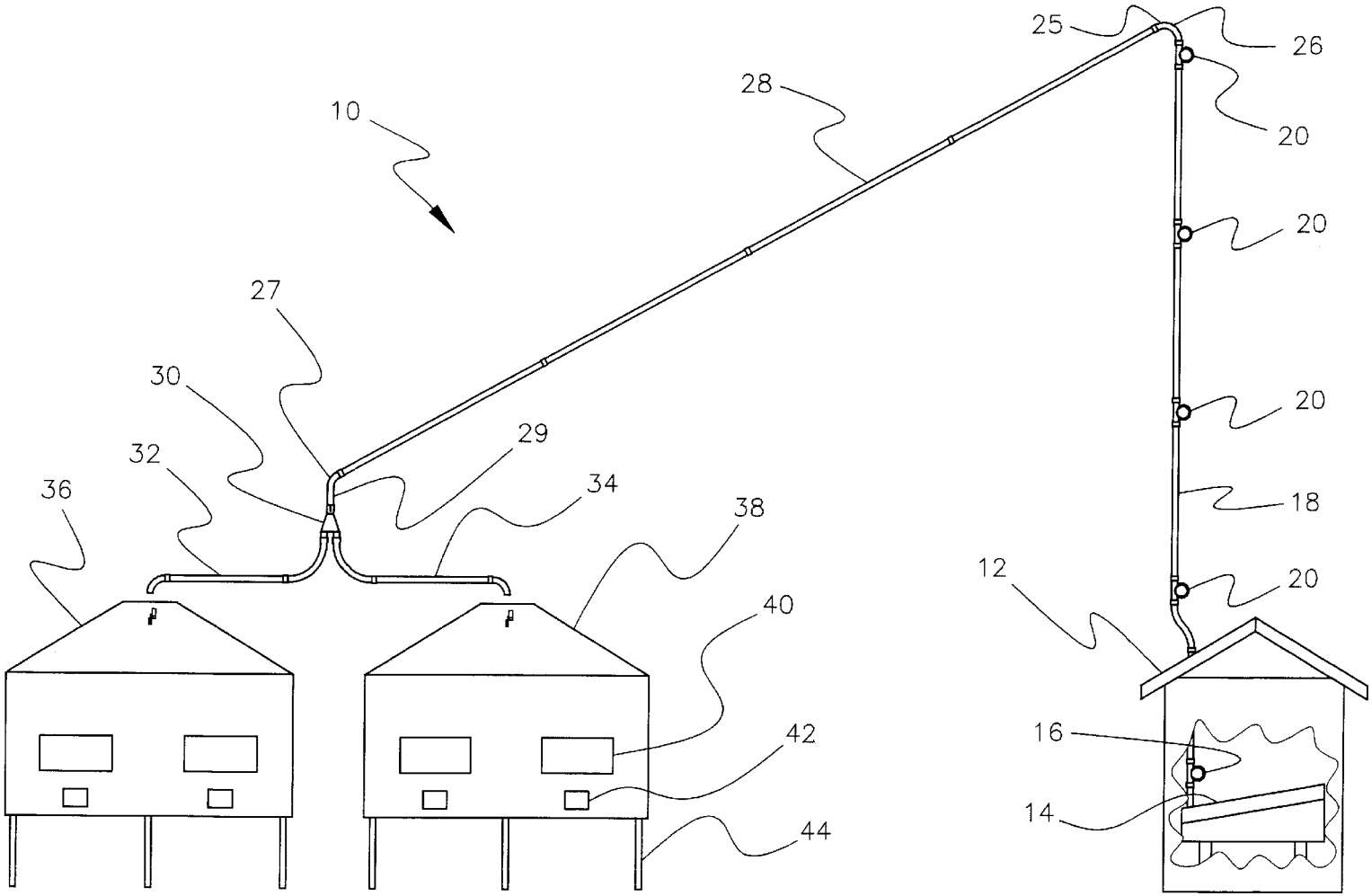
FIG. 1 is a diagrammatic view of the golf ball delivery system of this invention.
Figure 2:
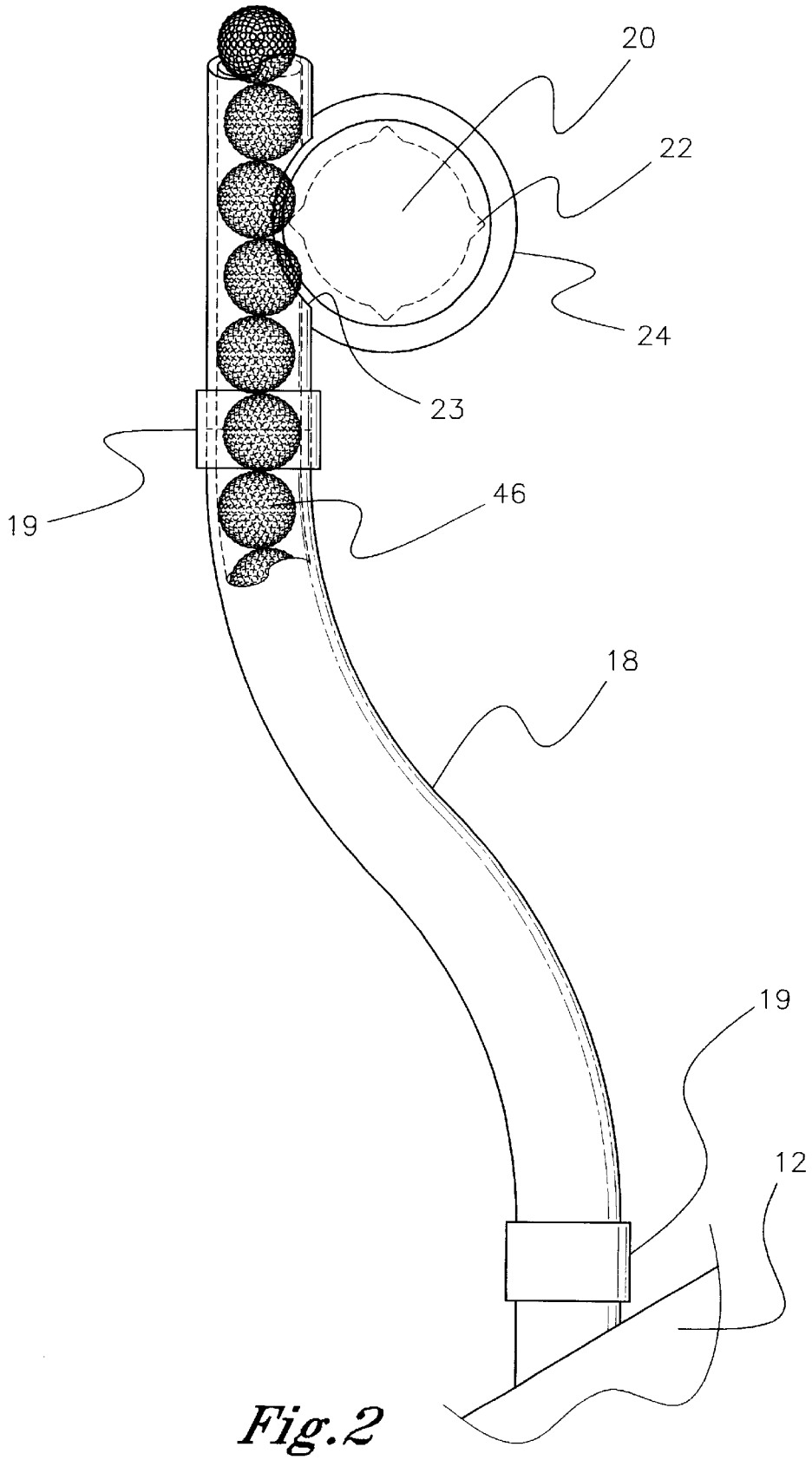
FIG. 2 is a side elevational view of golf balls being lifted in a vertical cylindrical tube.
Figure 3:
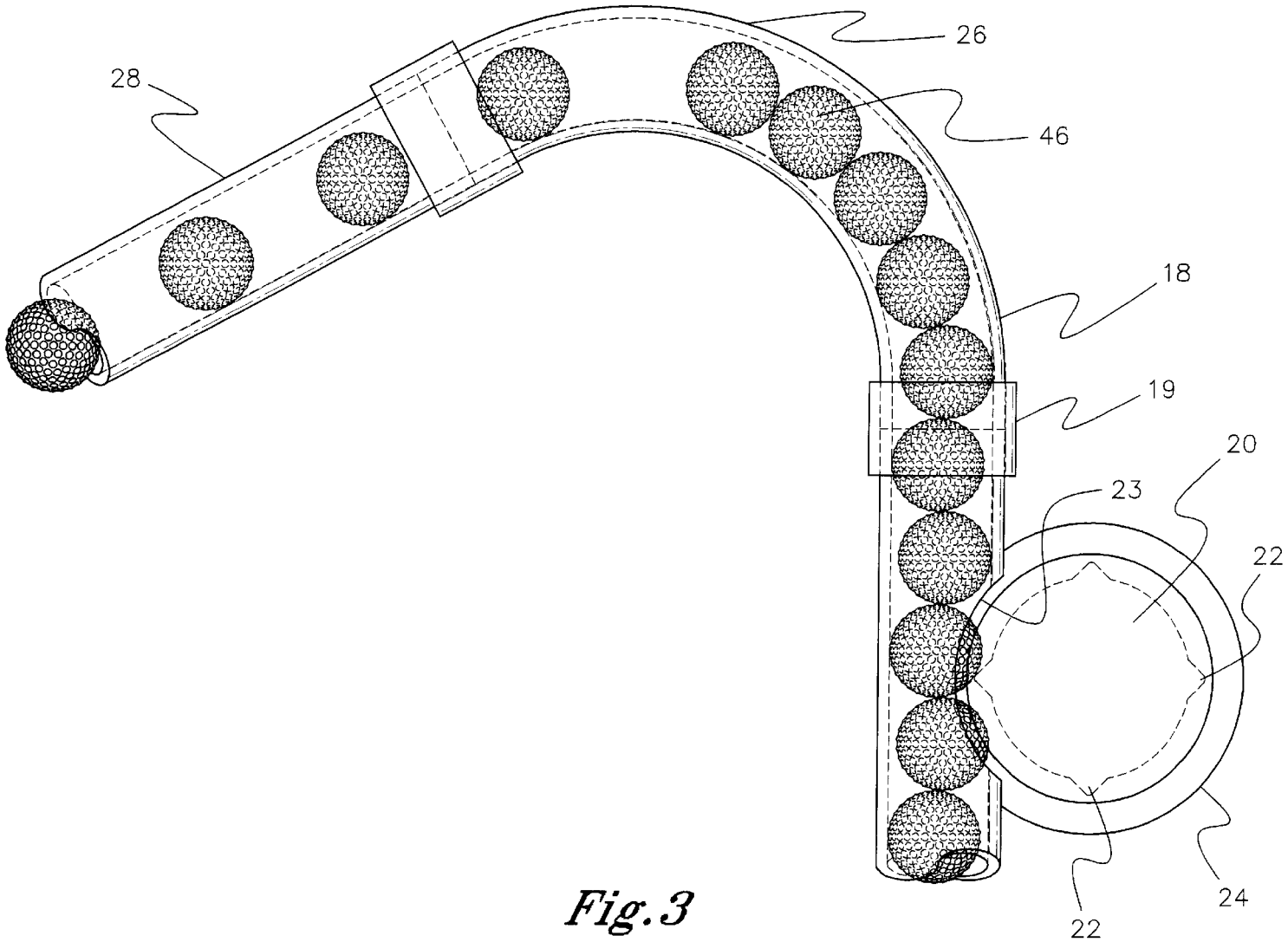
FIG. 3 is a side elevational view of the golf balls reaching the apex of the first vertical cylindrical tube and falling by gravity into the second inclined tube.

Throughout the following detailed description, the same reference numerals refer to the same elements in all figures.

Referring first to FIG. 1, the golf ball delivery system 10 of this invention begins when golf balls are picked up from a golf practice ground area in the conventional manner by a golf retrieval vehicle (not shown) and deposited in a cleaning house 12 where the balls are washed in the conventional manner and deposited in a tray 14. The tray is inclined toward a bottom end of a first vertical cylindrical tube 18. A booster device 16 includes a motorized wheel positioned over an opening at the bottom end of the first cylindrical tube 18 that lifts the golf balls into a first vertical cylindrical tube 18. Sections of vertical cylindrical tube 18 and tube 28 are held together by sleeves 19. The golf balls 46 are projected upwardly in the vertical cylindrical tube 18 by multiple rotating wheels 20, spaced apart along the vertical section of the cylindrical tube. Each wheel 20 has multiple finger projections 22 from its circumference that project into a side opening 23 in the cylindrical tube 18. The wheel 20 and projections are made of a hardened elastomer such as neoprene. Other equivalent materials can be employed in place of neoprene. These finger projections 22 lift the golf ball 46 as the rotating wheel turns clockwise. A one-eighth horsepower electric motor 24 drives each rotating wheel 20.

Each golf ball 46 moves up the first vertical cylindrical tube 18 to the tube's apex 26 where it meets a first end 25 of a second inclined tube 28. Thereafter, the golf ball 46 falls by gravity at approximately four inches every ten feet from the starting height of about thirty feet at apex 26 and eventually arrives at an end 27 of the inclined tube where a drop tube 29 leading to a diverter 30 is located. The apex could be higher or lower depending on the distance to the dispensers 36 and 38. The diverter 30 operates in response to an electromagnetic switch 52 as shown in FIGS. 4–7 to direct the golf balls 46 to go either to the first dispenser delivery tube 32 or the second dispenser delivery tube 34. The first delivery tube 32 leads to a first dispenser 36 and the second delivery tube 34 leads to a second dispenser 38.

Figure 4:
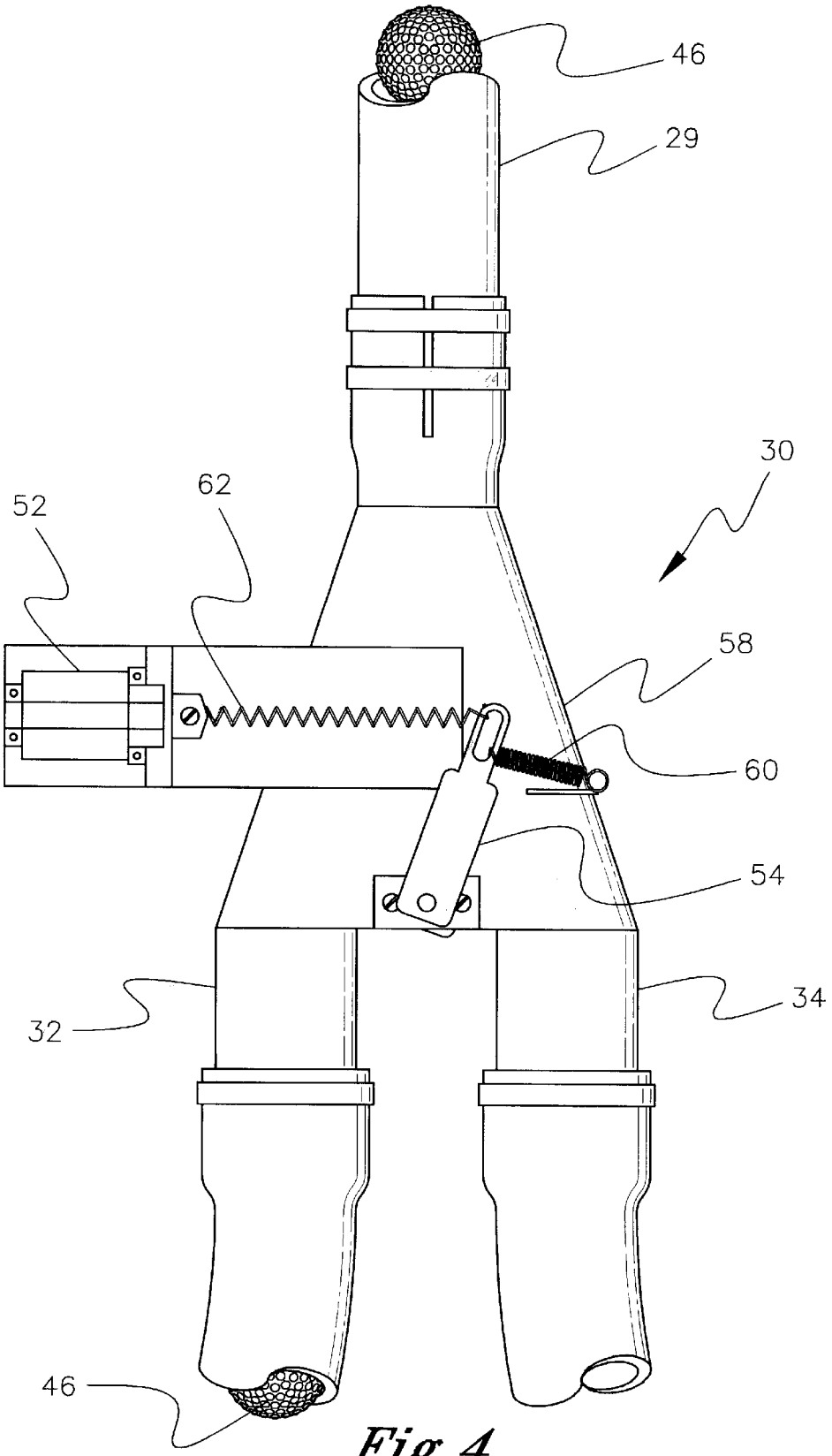
FIG. 4 is a side elevational view of the ball diverter directing a ball to the left side tube for delivery to a first ball dispenser.
Figure 5:
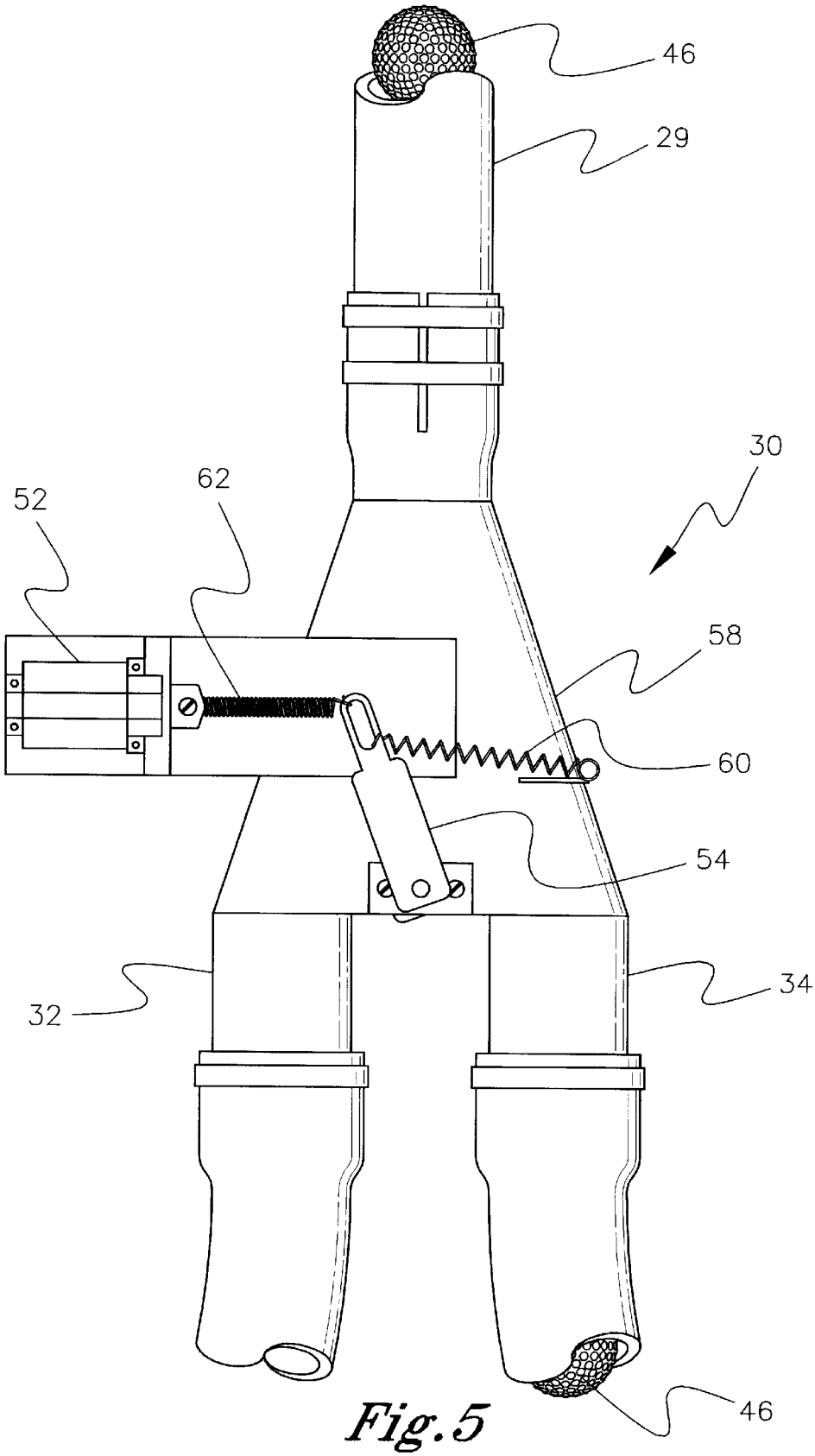
FIG. 5 is a side elevational view of the ball diverter directing a ball to the right side tube for delivery to a second ball dispenser.
Figure 6:
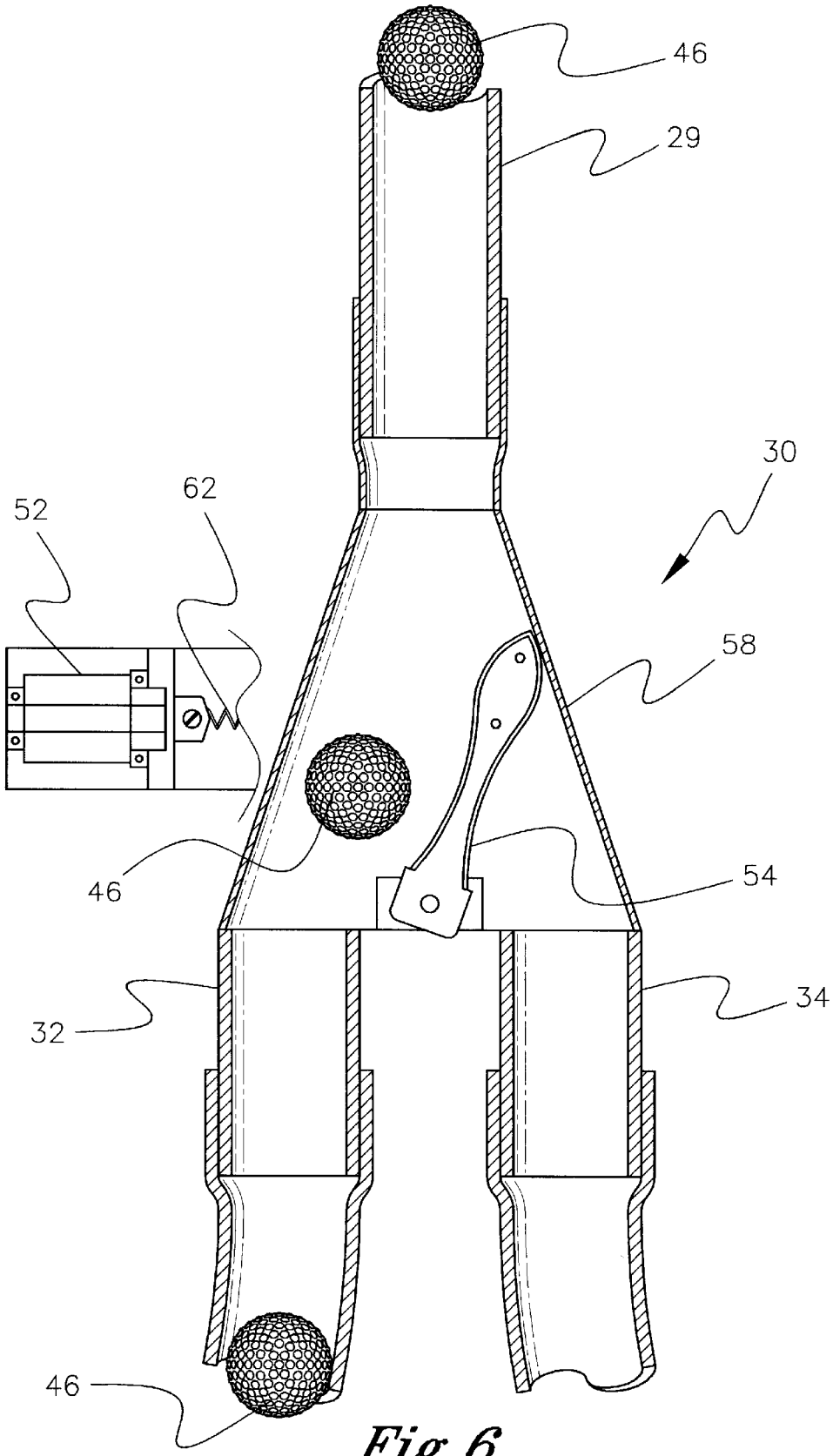
FIG. 6 is a side elevational view in section of the ball diverter according to FIG. 4.
Figure 7:
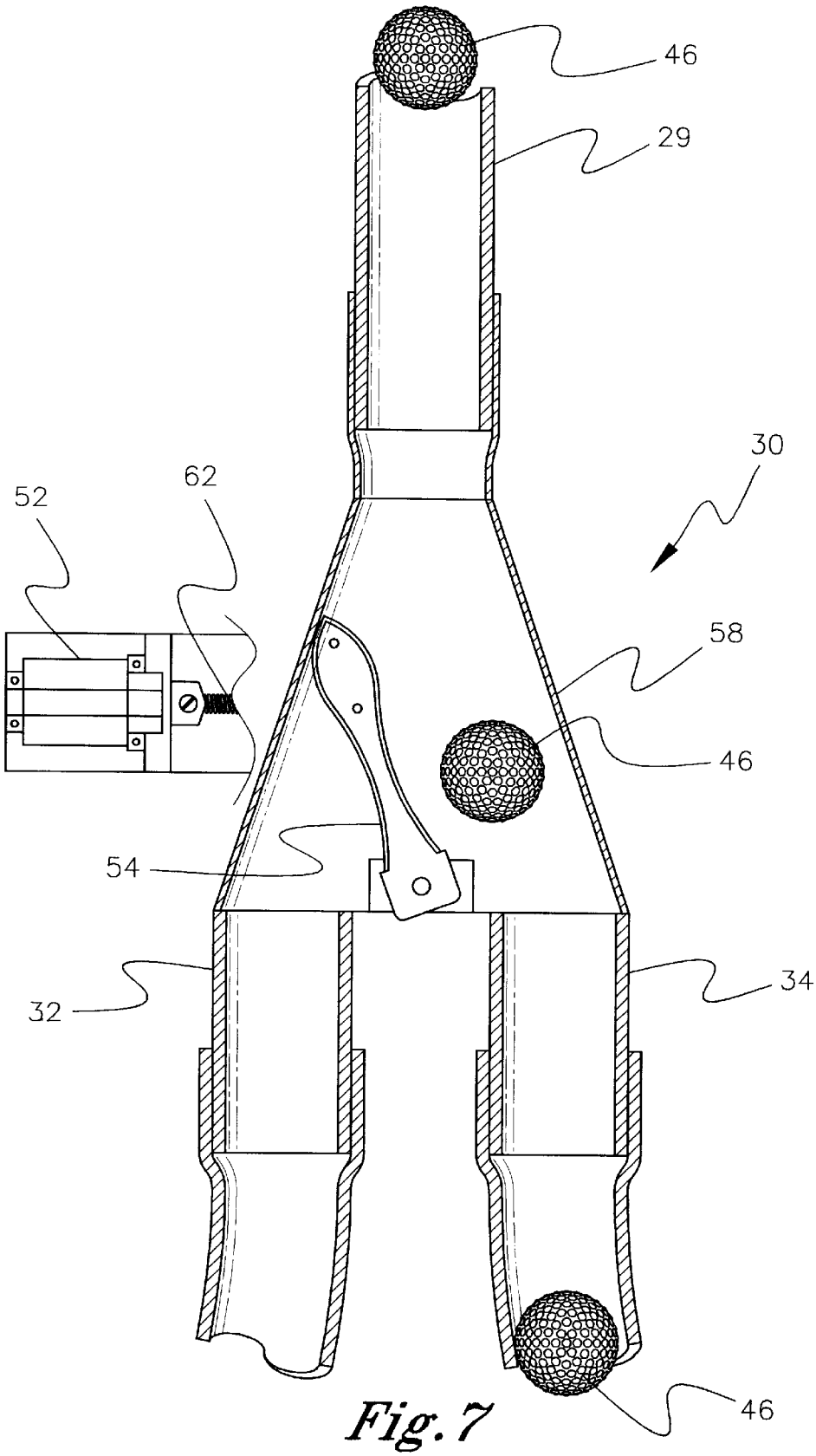
FIG. 7 is a side elevational view in section of the ball diverter according to FIG. 5.
Figure 8:
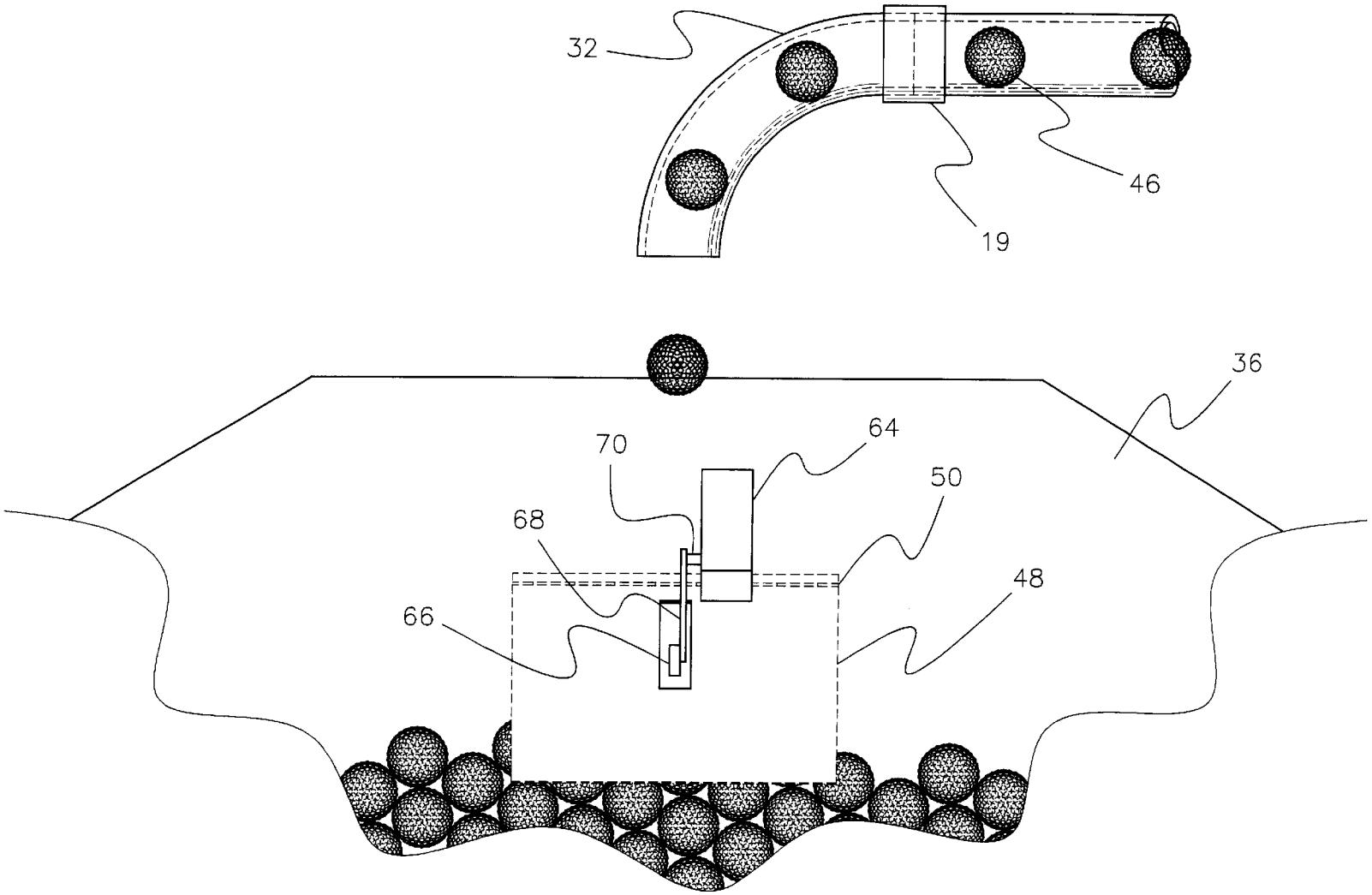
FIG. 8 is a partial side elevational view of a ball dispenser being filled with golf balls.
Figure 9:
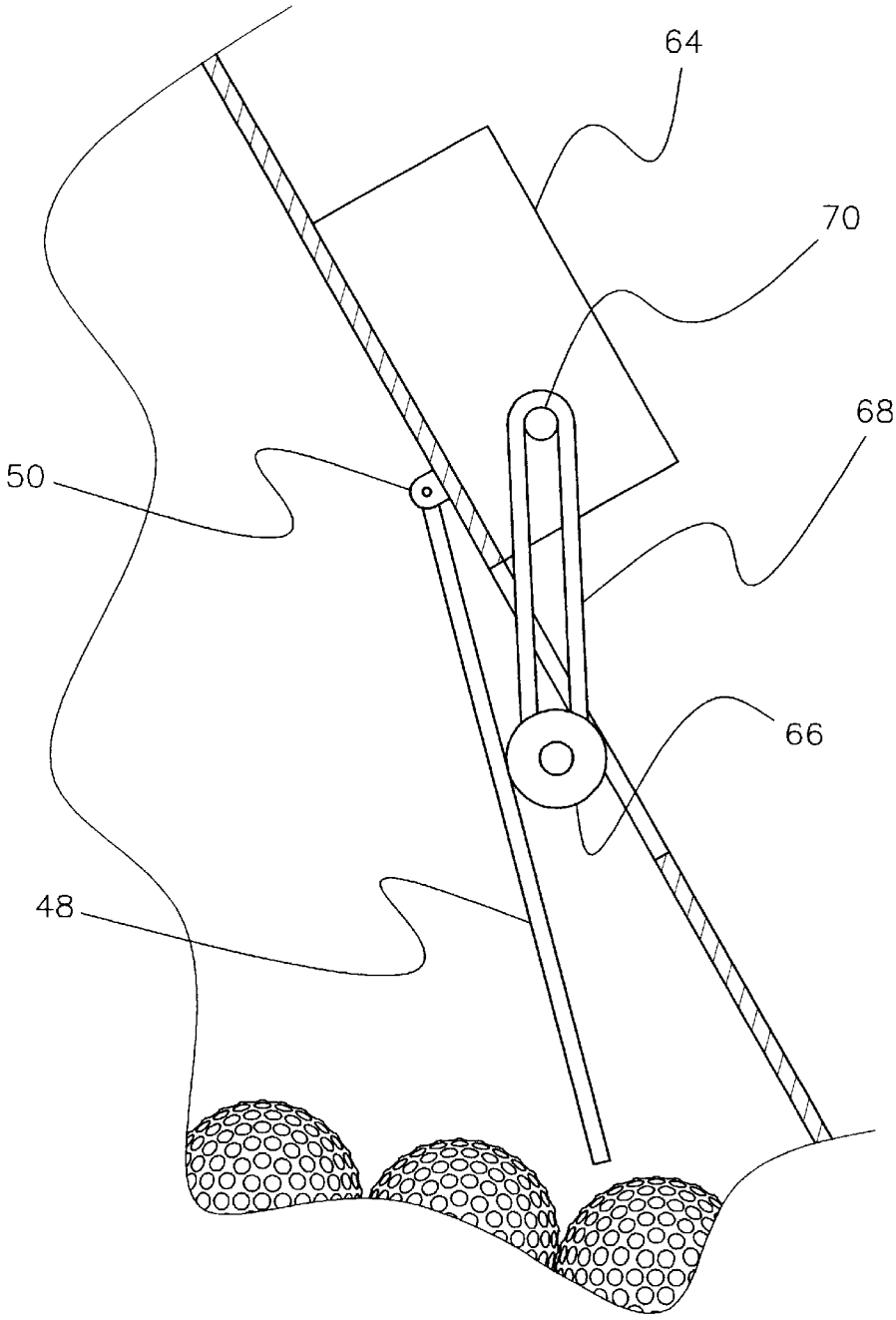
FIG. 9 is a partial side elevational view of a mechanism in the dispenser for determining when the dispenser is full.

Referring to FIGS. 4–7, the ball diverter 30 receives a golf ball 46 from drop tube 29. As the ball 46 falls by gravity into the central housing 58 of the diverter 30, a control bar 54 is normally pulled to the right by spring 60 which has greater tension than spring 62, so the golf ball 46 is diverted to tube 32, as seen in FIGS. 4 and 6. When dispenser 36 is filled, the control bar 54 moves to the left in response to spring 62 which is energized by an electromagnetic signal at switch 52 coming from the electrical signal generated in dispenser 36 by the lifting of lift bar 48. Roller 66 moves in response to an upward movement of lift bar 48 causing arm 68 to move shaft 70 and close an electrical switch in box 64. Switch box 64 is electrically connected to switch 52. This causes electromagnetic switch 52 to be energized to pull spring 62. As a result, control bar 54 moves to the left and golf balls fall into tube 34. When the lift bar 48, pivoting at point 50, moves to a closed position shown in FIG. 10 in dispenser 38, the electromagnetic switch 52 is de-energized by the dispenser lift bar 48. The control bar 54 moves back to the position shown in FIG. 6 allowing balls to go into dispenser 36.

Figure 10:
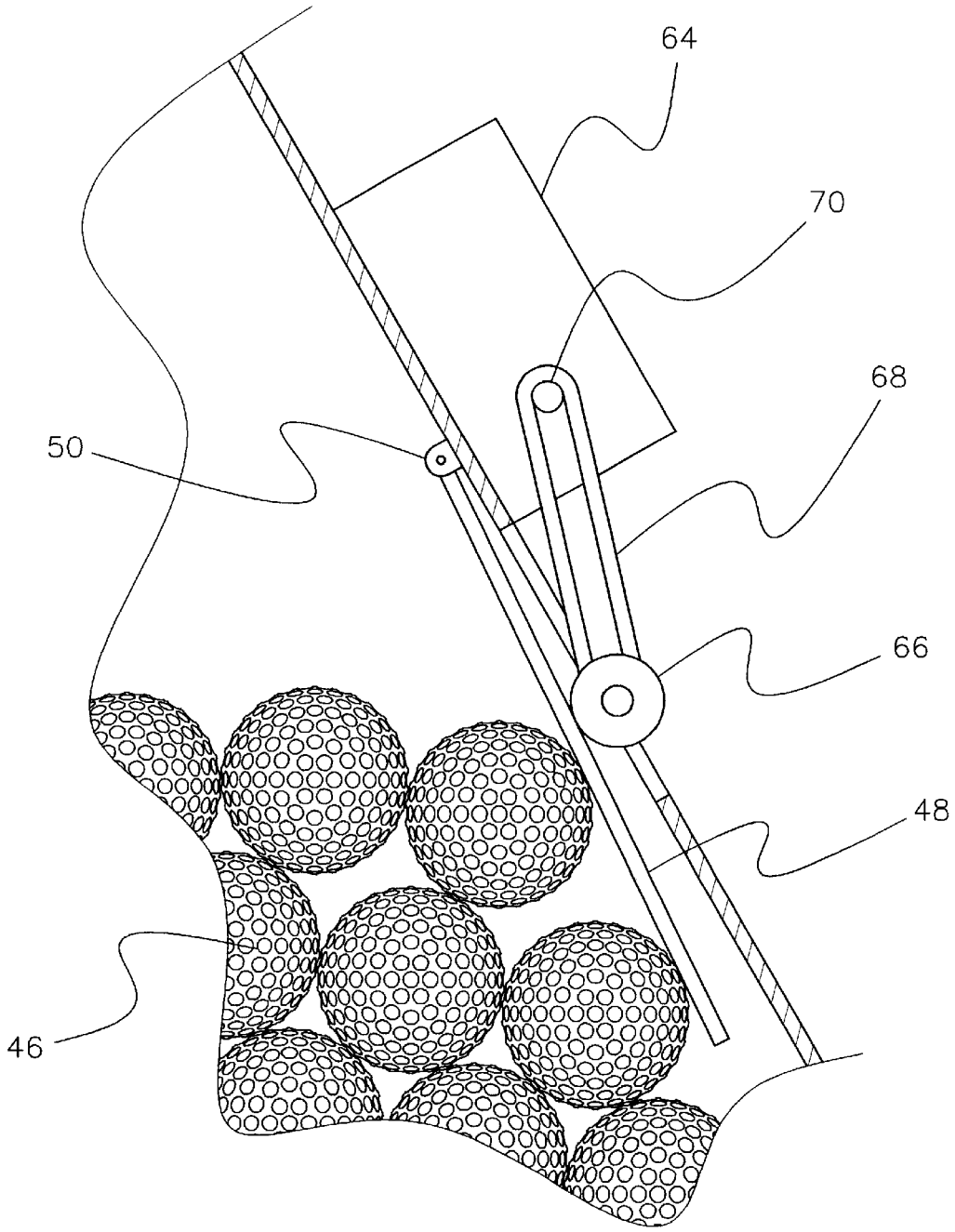
FIG. 10 is a partial side elevational view of the mechanism of FIG. 9 indicating that the dispenser is full.

The diverter 30 thereafter diverts all the golf balls again through the first tube 32 to the first dispenser 36 until such time as the lift bar 48 in the first dispenser bar comes into position shown in FIG. 10 whereupon, the balls will no longer flow into the dispenser 36 but will thereafter start falling again into dispenser 38 until it is filled. This is a continuous process which keeps all dispensers filled based on a number of golf balls in the system sufficient to fill all available dispensers.

If the distance between the cleaning house and the dispensers is too great, it would be possible to erect a second vertical cylindrical tube having rotating wheels to lift the balls further and thereafter, allow them to fall once again into an inclined tube and thereafter, into the diverter and then to the dispensers. Additional diverters can be employed if more than two dispensers are employed.

Through the use of this system, dispenser 36 and 38 are kept continuously filled. The golf balls 46 can be viewed through viewing window 40 by the golfer and after placing a coin into the dispenser coin slot can receive golf balls through chutes 42. Dispensers are usually mounted on support legs 44 for convenience.

Figure 11:
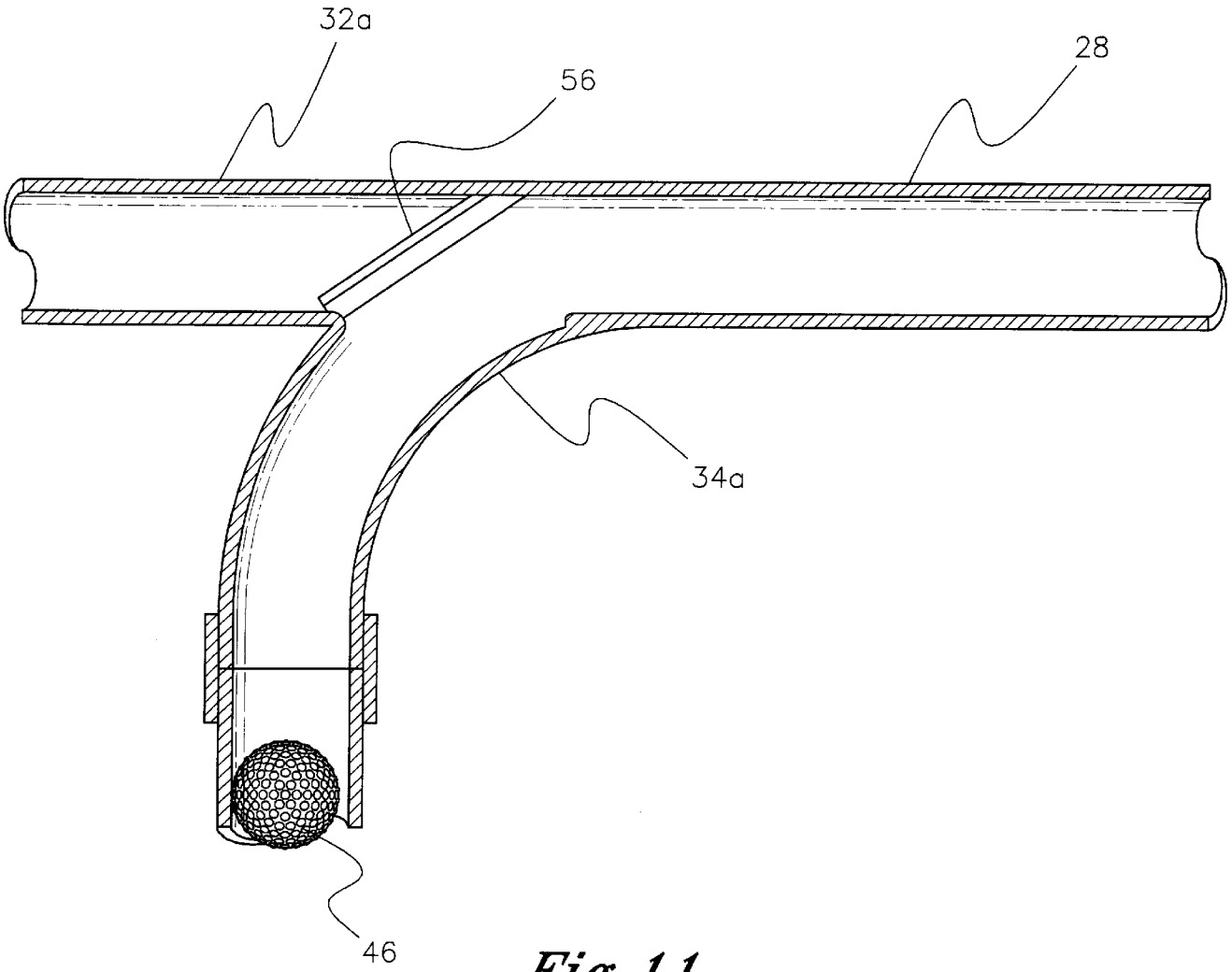
FIG. 11 is an alternate diverter with a door flap closed to send a golf ball to the second dispenser.
Figure 12:
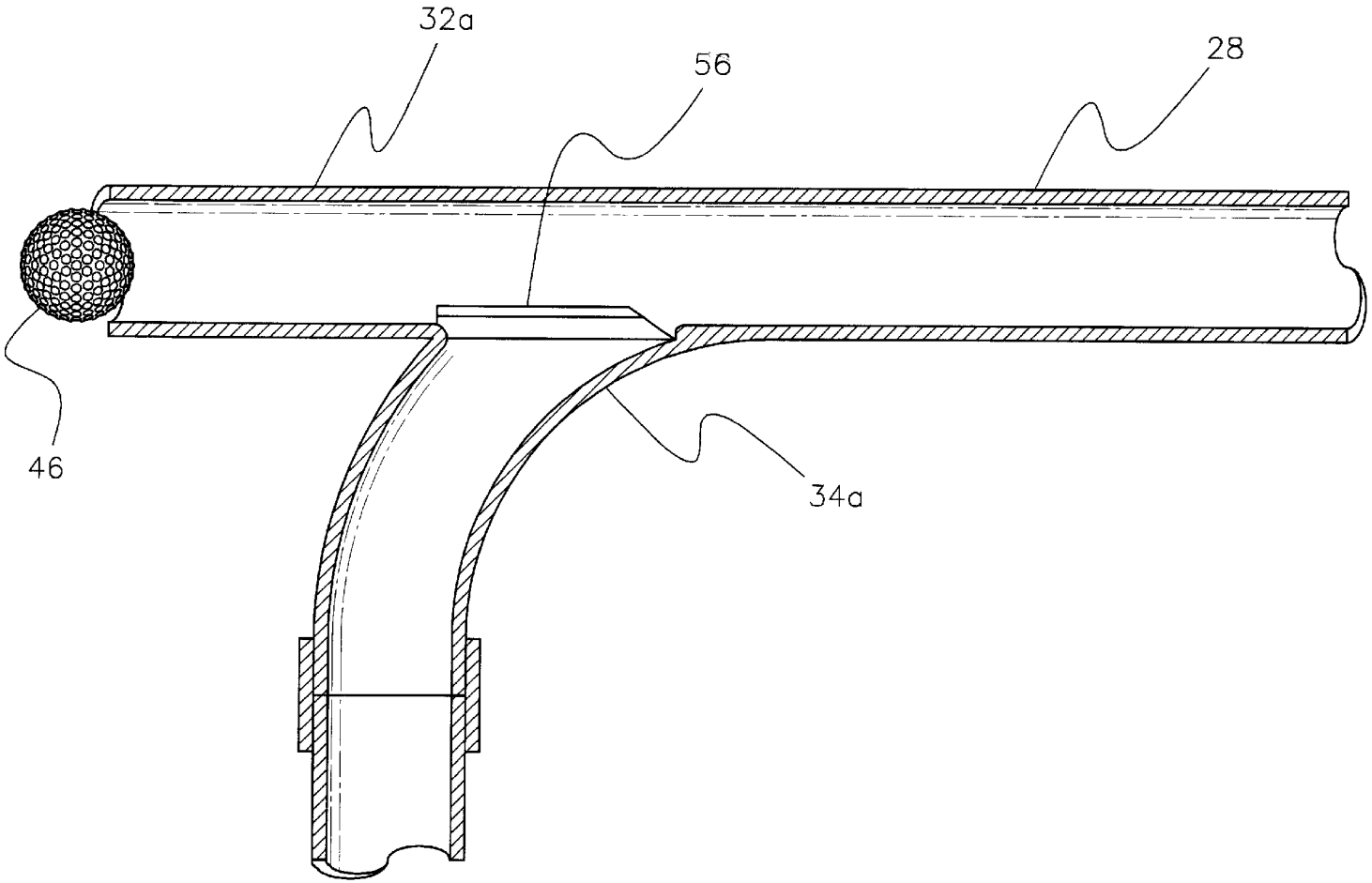
FIG. 12 is a n alternate diverter with a door flap closed to send a golf ball to the first dispenser.

Alternatively, as shown in FIGS. 11 and 12, a golf ball moving through tube 28 can be directed to dispenser 36 by normally closed flap door 56. Tube 32*a* will lead directly to dispenser 36. When dispenser 36 is filled, lift bar 48 will send an electromagnetic signal to flap door 56 which will then lift (FIG. 11) to prevent balls from rolling into tube 32*a* and will instead roll into tube 34*a* and thus into dispenser 38. When dispenser 38 is filled, the electromagnetic switch is de-energized and the flap door 56 drops to the position seen in FIG. 12.

Using the golf ball delivery system 10, as described herein, golf balls can move from the cleaning house directly to the dispensers without having any input from any service individuals. In this manner, the entire system is automatic subsequent to delivery of the golf balls 46 to the first vertical cylindrical tube 18.

The above description has described specific structural details of the golf ball delivery system. However, it will be within one having skill in the art to make modifications without departing from the spirit and scope of the underlying inventive concept of this golf ball delivery system. The inventive concept for the methods employed are not limited to the structure you described but include such modification and equivalence as would normally be employed in such a system.

Having thus described the invention, what is claimed and desired to be secured by Letters Patent is:

1. A golf ball delivery system comprising:

(a) a first cylindrical tube having a diameter sufficient to accommodate a golf ball, the cylindrical tube mounted in a substantially vertical direction over a means for retaining multiple golf balls;

(b) a ball booster adapted to push the golf balls upwardly into the substantially vertical tube from the means for retaining multiple golf balls;

(c) a plurality of rotating wheels each having projections; a plurality of spaced apart openings in the substantially vertical tube, each of said openings receiving projections from a respective one of said rotating wheels the projections lifting a golf ball in the substantially vertical tube to a topmost apex from which the golf balls thereafter fall by gravity into a first end of a second cylindrical tube positioned at a slight incline to a surface below the second cylindrical tube;

(d) a second end of the second cylindrical tube leading to a golf ball diverter, the diverter directing the golf ball to one of golf ball dispensers located in a golf practice area and from which golfers can obtain practice golf balls.

2. The golf ball delivery system according to claim 1 wherein the means for retaining multiple golf balls is a tray inclined towards a bottom end of the first cylindrical tube.

3. The golf ball delivery system according to claim 2 wherein the ball booster is a motorized wheel positioned over an opening at the bottom end of the first cylindrical tube lifting golf balls from the inclined tray into the first cylindrical tube.

4. The golf ball delivery system according to claim 1 wherein the golf ball diverter has a central housing containing a control bar activated by a spring responding to an electromagnetic signal from a first one of said golf ball dispensers so that the golf ball will be directed to a second one of said golf ball dispensers.

5. The golf ball delivery system according to claim 1 wherein each dispenser contains a lift arm that rises when the dispenser is filled with golf balls, the lift arm in a raised position actuating an electromagnetic switch when the dispenser is filled with golf balls.

6. The golf ball delivery system according to claim 5 wherein the lift arm activated electromagnetic switch controls the orientation of a flap door in a tube carrying the golf ball so that the flap door permits a golf ball to be directed to a specific dispenser.

7. The golf ball delivery system according to claim 1 wherein the rotating wheels are energized by an AC electric motor.

8. The golf ball delivery system according to claim 1 wherein the rotating wheels are made from an hardened elastomer.

9. The golf ball delivery system according to claim 8 wherein the hardened elastomer is neoprene rubber.

10. A method of automatically delivering a golf ball from a cleaning station to a dispenser, the steps comprising:

(a) providing a first vertical cylindrical tube with an interior diameter suitable to accommodate a golf ball and having a bottom opening located in the cleaning station adjacent a golf ball repository, the golf balls inserted by a booster device into the first vertical cylindrical tube bottom opening;

(b) lifting the golf balls within the first vertical cylindrical tube by multiple motorized wheels spaced apart vertically, each wheel having multiple lifting fingers projecting from an exterior circumference of the wheel into an opening along a side of the first vertical cylindrical tube, the fingers acting to lift the golf balls vertically in the first vertical cylindrical tube to an apex;

(c) providing a second cylindrical tube for the golf balls, the second cylindrical tube leading from the apex on a downward slope towards a diverter, and (d) the diverter directing the golf balls to any one of two golf ball dispensers in response to an electrical signal from one of the dispensers.

11. The method according to claim 10 wherein the apex of the first vertical cylinder is provided about thirty feet above the cleaning station and the second cylindrical tube is provided with a downward incline of about four inches every ten feet.

12. The method according to claim 10 wherein a spring in the diverter is activated by an electromagnetic switch to move a control bar from a normal position directing golf balls to a first dispenser to an activated position so that golf balls fall to a second golf ball dispenser.

* * * * *

UNITED STATES PATENT AND TRADEMARK OFFICE

CERTIFICATE OF CORRECTION

PATENT NO. : 6,287,212 B1
DATED : September 11, 2001
INVENTOR(S) : Bruce B. Wetherell It is certified that error appears in the above-identified patent and that said Letters Patent is hereby corrected as shown below:

Title page,
Item [76], the second and third inventor should be deleted, so that Bruce B. Wetherell appears as the sole inventor, as shown below:

-- Item [76] Inventor: Bruce B. Wetherell, 1360 Highland Dr., Clearwater, FL (US) --.

Signed and Sealed this

Twelfth Day of February, 2002

*Attest:*

*Attesting Officer*

JAMES E. ROGAN
*Director of the United States Patent and Trademark Office*